United States Patent [19]

Fengler et al.

[11] Patent Number: 4,994,838

[45] Date of Patent: Feb. 19, 1991

[54] WET PROCESSING ARRANGEMENT AND METHOD FOR PHOTOGRAPHIC REVERSAL MATERIAL

[75] Inventors: Harald Fengler, Taufkirchen; Georg Fryda; Wilfried Hehn, both of Munich, all of Fed. Rep. of Germany

[73] Assignee: AGFA-Gevaert Aktiengesellschaft, Leverkusen, Fed. Rep. of Germany

[21] Appl. No.: 392,666

[22] Filed: Aug. 11, 1989

[30] Foreign Application Priority Data

Aug. 23, 1988 [DE] Fed. Rep. of Germany ..... 3828492

[51] Int. Cl.[5] ..... G03D 11/00; G03D 3/08

[52] U.S. Cl. ..... 354/306; 354/322

[58] Field of Search ..... 354/306, 320, 321, 322

[56] References Cited

U.S. PATENT DOCUMENTS

| | | | |
|---|---|---|---|
| 1,762,936 | 6/1930 | Seymour | 354/306 |
| 3,119,319 | 1/1964 | Debrie | 354/306 |
| 3,511,160 | 5/1970 | Van Reusel | 354/306 |
| 3,672,290 | 6/1972 | Duesler | 354/306 |
| 4,806,962 | 2/1989 | Uchida et al. | 354/324 |
| 4,837,593 | 6/1989 | Hehn | 354/322 |

*Primary Examiner*—A. A. Mathews

*Attorney, Agent, or Firm*—Peter K. Kontler

[57] ABSTRACT

An arrangement for wet processing running lengths of exposed photographic reversal film has a pair of rinsing tanks downstream of a developing tank in which the film undergoes an initial development. The film consecutively advances through the two rinsing tanks. A liquidtight container is mounted on the inner surface of the second rinsing tank adjacent to the path of the film and spans the width of such path. At least a portion of the container is disposed below the level of the bath in the second rinsing tank and this portion of the container is provided with a window which is transparent to light and extends across the width of the path followed by the film. A light source is arranged in the container behind the window. The film travels by the window with the emulsion facing the latter and is subjected to an additional exposure as it traverses the window.

18 Claims, 2 Drawing Sheets

WET PROCESSING ARRANGEMENT AND METHOD FOR PHOTOGRAPHIC REVERSAL MATERIAL

BACKGROUND OF THE INVENTION

The invention relates generally to the wet processing of photosensitive material, especially photographic reversal material.

More particularly, the invention relates to an arrangement for and a method of wet processing exposed photosensitive material. The arrangement contains a plurality of treating tanks, including at least one rinsing tank, and an illuminating unit for subjecting the photosensitive material to an additional exposure. The arrangement is further provided with entry rolls and transporting rolls for conveying the photosensitive material into, through and out of the tanks along a predetermined path. The illuminating unit is located near the path in the vicinity of a rinsing tank or other tank.

Such wet processing arrangements have long been known and commercially used for photographic reversal material. In accordance with the associated developing processes, these arrangements are designed with two rinsing baths downstream of the developing bath. It is necessary for the photographic layer or emulsion to undergo a second exposure in the region of the second rinsing bath. The exposure must be uniform over all of the material and is normally performed with a rod-like lamp which extends over the width of the material. The material is conveyed by the lamp and must be oriented in such a manner that the emulsion faces upward or inward as the material advances through a tank. The second exposure always takes place outside of the rinsing baths, mostly between the first and second rinsing baths. To this end, the sources of illumination must be disposed to the outside of or above the devices which direct the material from one tank to the other. In developing machines for rolls of photographic material, transparent directing devices are then required.

When the tanks are to be cleaned and the racks exchanged, the illuminating unit for the second exposure must be removed. The known arrangements also have the further drawback that protective devices are necessary in order to reliably prevent the scattering of light into the tanks, especially the first rinsing tank.

OBJECTS AND SUMMARY OF THE INVENTION

It is an object of the invention to provide a wet processing arrangement which allows unwanted scattering of radiation to be reduced without making special provision in the material transporting mechanism.

Another object of the invention is to provide a wet processing arrangement which enables the cleaning of a vessel to be accomplished without removal of the exposure unit.

An additional object of the invention is to arrange the exposure unit for a wet processing arrangement of the above type so that cleaning of a vessel is possible without removing the exposure unit and the material transporting mechanism need not have a special design.

A further object of the invention is to provide a wet processing method which permits undesired scattering of radiation to be reduced without requiring special design of the material transporting mechanism.

It is also an object of the invention to provide a wet processing method which makes it possible to clean a vessel without removing the exposure unit.

The preceding objects, as well as others which will become apparent as the description proceeds, are achieved by the invention.

One aspect of the invention resides in an arrangement for wet processing exposed photosensitive material, particularly photographic reversal material. The arrangement comprises at least one vessel or tank for a treating bath and a source of electromagnetic radiation, e.g., a source of illumination such as a lamp, in the vessel.

The tank preferably accommodates a rinsing bath and the arrangement may include one or more additional tanks or vessels for one or more additional treating baths for the material.

A container may be disposed in the tank with the radiation source and the latter may be located in the container. The container then has a section which is transparent to the radiation, e.g., light, emitted by the source. It is preferred for the container to be liquidtight.

The arrangement may further comprise transporting means in the tank with the radiation source and the transporting means serves to define a predetermined path for the photosensitive material. The container is advantageously coextensive with the transporting means, that is, advantageously spans the entire length of the transporting means. The path defined by the transporting means has a predetermined width and the transparent section of the container preferably extends across such width. The radiation source and the transparent section of the container are arranged so as to irradiate the path. The transporting means may include a plurality of rolls which function to draw the photosensitive material into the tank with the radiation source, to convey the photosensitive material through the tank and to discharge the photosensitive material from the tank.

It is preferred to transport the photosensitive material through a tank in such a manner that the emulsion faces outward or downward. The radiation source in the respective tank is then situated accordingly, i.e., between the path of the photosensitive material and the exterior of the tank.

The radiation source functions to subject the photosensitive material to an additional exposure. The wet processing arrangement may include a pair of rinsing tanks which are located adjacent to one another in the path of the photosensitive material so that the photosensitive material successively passes through the rinsing tanks. The radiation source is then advantageously located in the second or downstream tank.

By situating the radiation source in a treating tank for the photosensitive material, and preferably in a liquidtight container disposed within the tank, the material transporting and guiding mechanisms for all tanks of the wet processing arrangement may have the same construction. Furthermore, the exposure unit containing the radiation source need not be removed for cleaning of the tanks and no shields are required in order to prevent unwanted entry of radiation into a neighboring tank. Moreover, the radiation source itself can be exchanged in a simple manner.

Another aspect of the invention resides in a method of wet processing exposed photo-sensitive material, particularly photographic reversal material. The method comprises the steps of conveying the photosensitive material through at least one treating bath, preferably a rinsing bath, and additionally exposing the photosensitive material in the bath.

The method may include successively conveying the photosensitive material through the one bath and another bath preceding the one bath, and each of these baths may be a rinsing bath.

The step of additionally exposing the photosensitive material is carried out using a source of electromagnetic radiation and the conveying step is advantageously performed so that the emulsion on the photosensitive material faces the source during the additional exposure.

The novel features which are considered as characteristic of the invention are set forth in particular in the appended claims. The improved wet processing method, as well as the construction and mode of operation of the improved wet processing arrangement, together with additional features and advantages of the method and arrangement, will, however, be best understood upon perusal of the following detailed description of certain specific embodiments when read in conjunction with the accompanying drawings.

DESCRIPTION OF THE PREFERRED EMBODIMENTS

Figure 1:
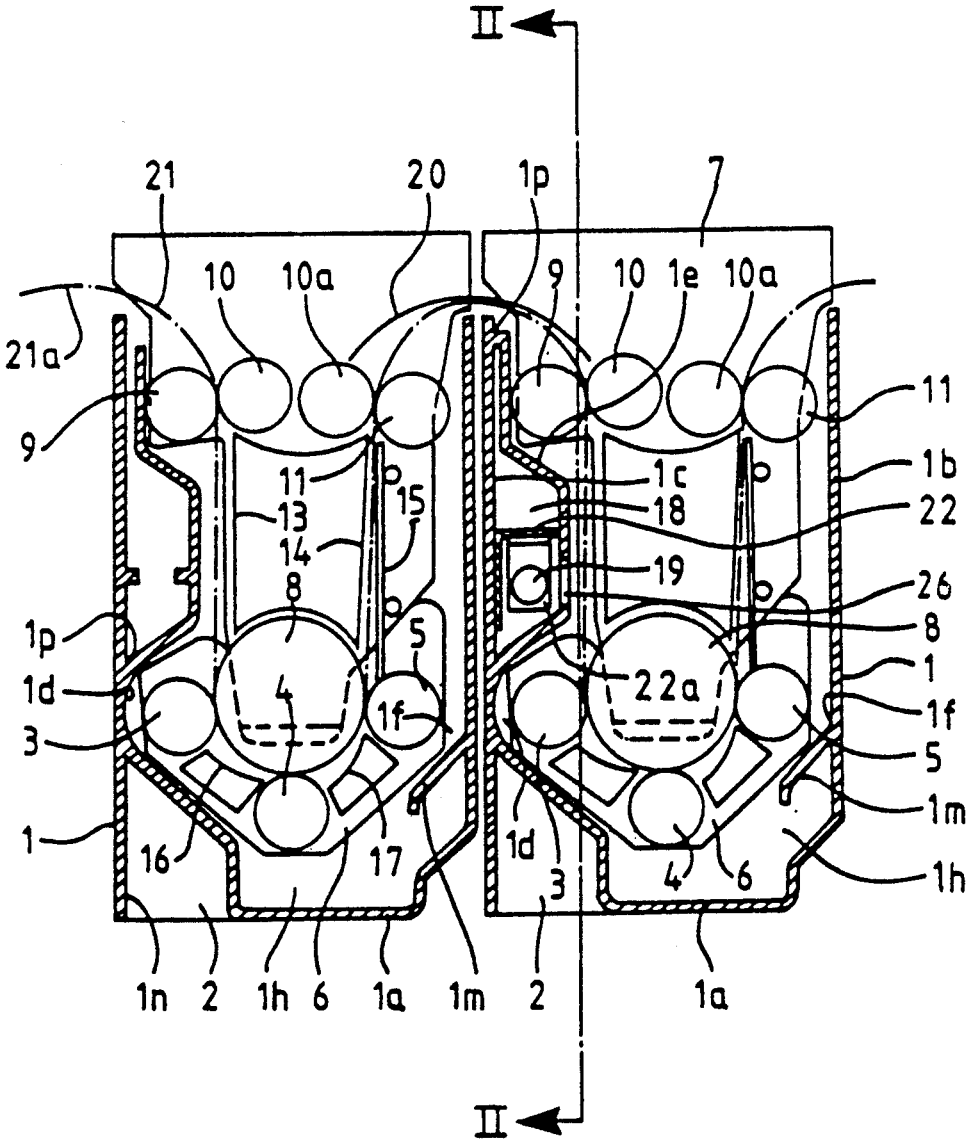
FIG. 1 is a transverse sectional view through a pair of treating tanks of an arrangement according to the invention for the wet processing of exposed photosensitive material.
Figure 2:
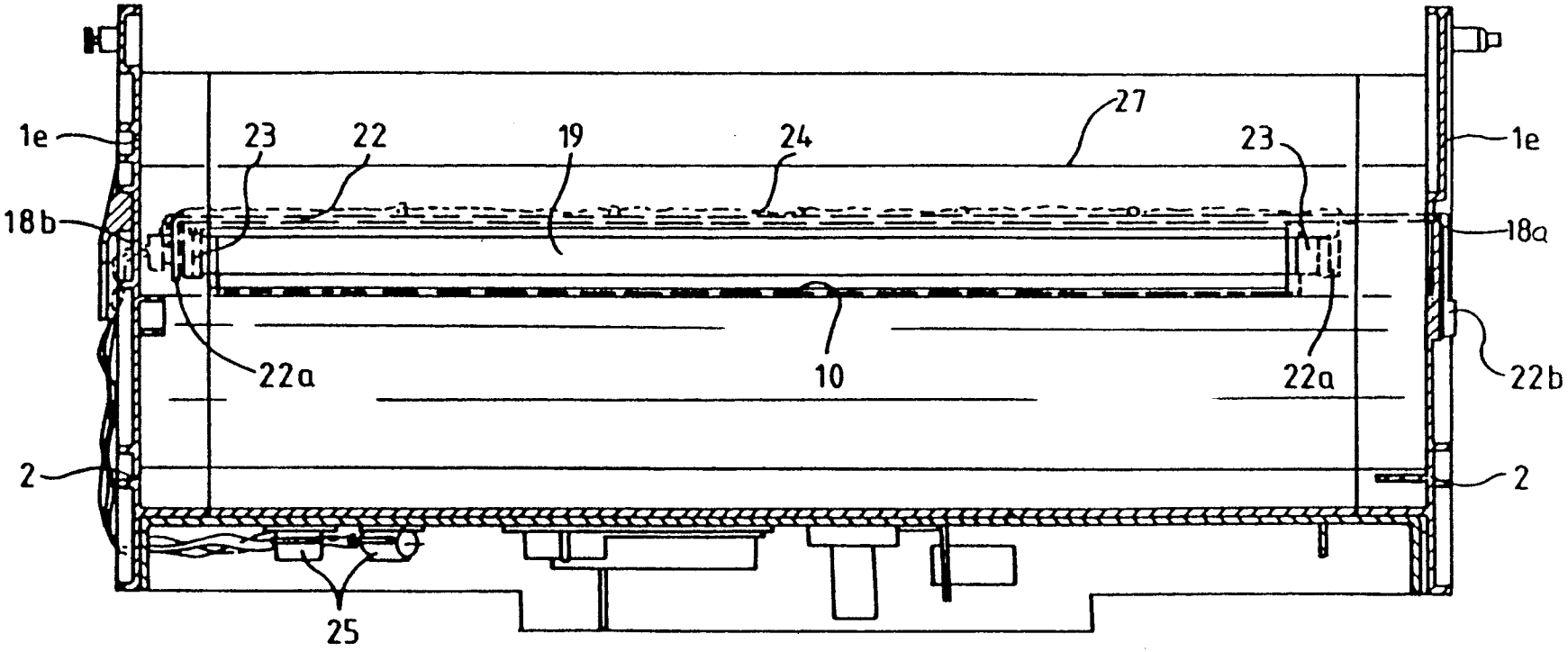
FIG. 2 is a section as seen in the direction of the arrows II—II of FIG. 1.

FIGS. 1 and 2 illustrate part of an arrangement for the wet processing of exposed photosensitive material 21 which is here assumed to be photographic reversal film. The arrangement includes a pair of treating tanks or vessels which are disposed adjacent to one another, and the photographic material 21 is consecutively advanced through the two tanks. In the showing of FIG. 1, the photographic material 21, which is in the form of a running length of photographic material, first passes through the tank on the left and then through the tank on the right. Each of the two tanks accommodates a rinsing bath and the level of the rinsing baths is indicated at 27 in FIG. 2.

The tanks shown in FIG. 1 are similar in many respects and, in order to avoid repetition, only the right-hand tank will be described. Unless otherwise stated, the description applies to the left-hand tank also. Corresponding parts of the two tanks have been assigned the same reference numerals.

The reference numeral 1 generally identifies a tank segment which extends across the width of the photographic material 21. The tank segment 1 includes a longitudinal bottom wall 1*a* and two longitudinal side walls 1*b* and 1*c* of the tank. The tank has a hollow or enlargement 1*d* in the region of the bottom portion of the side wall 1*c*. The enlargement 1*d* is bounded from below by a section of the side wall 1*c* which extends inward and downward, and from above by an upwardly and inwardly inclined section of a wall 1*e* which defines a container 18 internally of the tank in the region of an upper portion of the side wall 1*c*. The container 18 extends longitudinally of the tank and runs the length thereof. The container wall 1*e*, which is formed on the inner surface of the side wall 1*c*, defines a constriction inside the tank since it projects upward and inward into the interior of the latter. The side wall 1*c* has a protruding, rib-like additional section 1*n* which extends straight down from the area of the enlargement 1*d* and terminates at the level of the bottom wall la so that, when the bottom wall 1*a* is placed on a surface, the section 1*n* of the side wall 1*c* engages such surface. The section 1*n* constitutes an additional support or stabilizing leg which permits the tank to be securely positioned on a surface.

An inwardly and downwardly inclined flange 1*m* is formed on the side wall 1*b* of the tank in the region of the lower portion thereof. Due to the inward and downward inclination of the flange 1*m*, a second enlargement 1*f* is formed internally of the tank at approximately the level of the enlargement 1*d*. The side wall 1*b* has a section which is located below the flange 1*m* and extends inward and downward, and this section, together with the inwardly and downwardly extending section of the side wall 1*c* below the enlargement 1*d*, causes a constricted area 1*h* to be defined at the bottom of the tank.

The tank segment 1, which is preferably an extruded part, is brought to the required length for the tank.

The tank further includes two approximately symmetrical end walls 2 consisting of essentially flat support and closure plates or sheets. In order to increase the stability of the tank, the end walls 2 may project beyond the edges of the tank segment 1. The sides of the end walls 2 which face the edges of the tank segment 1 are provided with protruding ribs having a cross-sectional configuration which corresponds to the cross-sectional configuration of the tank segment 1. The ribs thus register with the edges of the tank segment 1 when the end walls 2 are applied to the tank segment 1, and the ribs are welded to the tank segment 1 by means of a known process.

Transporting rolls 3, 4 and 5 for the photographic material 21 are disposed in the lower portion of the tank 1,2. These transporting rolls 3,4,5 are journalled in such a manner that the transporting roll 3 is at least partially accommodated in the enlargement 1*d*, the transporting roll 5 is at least partially accommodated in the enlargement 1*f* and the transporting roll 4 is at least partially accommodated in the constricted area 1*h*.

As described previously, the tank 1,2 has a constriction between the container wall 1*e* and the tank side wall 1*b*, and the enlargements 1*d* and 1*f* are located below such constriction. In order that the lower transporting rolls 3,4,5 may be inserted in such tank 1,2, the lower transporting rolls 3,4,5 either must be removably journalled directly on the end walls 2 or must be journalled on a rack segment 6 which can be moved past the constriction by tilting and then positioned on or near the bottom wall 1*a* of the tank 1,2. If the transporting rolls 3,4,5 are to be removably journalled directly on the end walls 2, bearing supports for the direct seating of the transporting rolls 3,4,5 may be formed on the end walls 2 at suitable locations near the edges of the tank segment 1. These bearing supports, which are not illustrated in the drawings to preserve clarity, are upwardly open so that the shafts of the rolls 3,4,5 may be placed in the bearing supports from above.

It is of advantage for the end walls 2 to be formed with bearing supports for the lower, outer transporting rolls 3,4,5 and for the latter to be directly journalled on the end walls 2. Thus, this allows the rack segment 6 to be eliminated. The transporting rolls 3,4,5 are not motor driven.

If the rack segment 6 is employed, tilting of the rack segment 6 during insertion in the tank 1,2 so as to move the rack segment 6 past the constriction between the container wall 1*e* and the tank side wall 1*b* allows accumulated air at the lower side of the rack segment 6 to escape. Accordingly, tilting of the rack segment 6 additionally serves a venting function. The inwardly and downwardly inclined flange 1*m* on the tank side wall 1*b*, as well as the inwardly and downwardly inclined section of the tank side wall 1*c*, may serve as supports for the rack segment 6.

A second rack segment 7 is placed on top of the lower rack segment 6 or on top of the lower transporting rolls 3,4,5. The rack segment 7 includes a pair of oppositely disposed, spaced end walls and a relatively large transporting roll 8 is mounted on these end walls at the lower end of the rack segment 7. The transporting roll 8, which is driven, lies against or on the lower transporting rolls 3,4,5. A first pair of rolls 9 and 10 for drawing the photographic material 21 into the tank 1,2, a second pair of rolls 10*a* and 11 for discharging the photographic material 21 from the tank 1,2 and guide means with guide surfaces 13 and 14 for the photographic material 21 are also formed or otherwise mounted on the end walls of the rack segment 7. The guide surface 13 extends between the roll 8 and the roll pair 9,10 while the guide surface 14 extends between the roll 8 and the roll pair 10*a*,11. A guide element with a guide surface 15 for the photographic material 21 is likewise secured to the rack segment 7 with the guide surface 15 extending between the rolls 5 and 11. Two additional guide elements with respective guide surfaces 16 and 17 for the photographic material are also provided. The guide element with the guide surface 16 is situated between the rolls 3 and 4 whereas the guide element with the guide surface 17 is located between the rolls 4 and 5.

The container wall 1*e* has a generally vertical section extending upward from the inclined section of the container wall 1*e* which bounds the enlargement 1*d* from above. This generally vertical section has a surface which confronts the rack segment 7 and again constitutes a guide surface for the photographic material 21.

Several treating tanks can be suspended from, or positioned in adjoining relationship to, one another and thereby be connected to each other. This allows the various treating tanks to be placed in a common catch basin for treating liquid which may slosh out of the treating tanks.

In the illustrated embodiment, both of the treating tanks 1,2 constitute rinsing tanks which are disposed downstream of a developing tank as considered in the direction of travel of the photographic material 21, i.e., as considered in a direction from left to right in FIG. 1. The developing tank is not shown in the drawings. A guide element 20 in the form of a hollow, part-cylindrical component extends between the left roll 10*a* of the pair of discharging rolls 10*a*,11 in the first or left-hand tank 1,2 and the right roll 10 of the pair of entry rolls 9,10 in the second or right-hand tank 1,2. The photographic material 21 discharged from the first tank 1,2 by the associated discharging rolls 10*a*,11 comes into contact with the guide element 20 where it is deflected and directed steeply downward to the entry rolls 9,10 of the second tank 1,2. The photographic material 21 has an emulsion 21*a* and is transported in such a manner that the emulsion 21*a* faces downward toward the second tank 1,2 when the photographic material 21 contacts the guide element 20. Upon entry of the photographic material 21 into the tank 1,2, the emulsion 21 faces the tank side wall 1*c* and the container wall 1*e*. During transport of the photographic material 21 through the tanks 1,2, the emulsion 21*a* always faces outward of the respective tank 1,2 or downward, that is, the emulsion 21*a* either faces the nearest tank side wall 1*b*,1*c* or the tank bottom wall 1*a*.

All of the rolls 3,4,5,8,9,10,10*a*,11 in the tanks 1,2 lie below the upper surface 27 of the respective rinsing bath.

When developing exposed reversal film such as the photographic material 21, the film must be subjected to an additional exposure after the first development and the first rinse in the left-hand rinsing tank 1,2 of FIG. 1 but before the actual color development and the subsequent baths (third rinsing bath, bleach fixing bath and additional rinsing baths) following the second rinse in the right-hand rinsing tank 1,2 of FIG. 1. Until now, the additional exposure took place during passage of the photographic material 21 either from the first to the second rinsing tank or from the second rinsing tank to the color developer. This was accompanied by the drawbacks outlined earlier.

In accordance with the invention, these drawbacks may be avoided by arranging the source of electromagnetic radiation for the additional exposure, here a light source 19, in the container 18 formed inside the second rinsing tank 1,2 by the container wall le. Contrary to the container 18 in the first rinsing tank 1,2 which is open at the top in the section of FIG. 1, the container 18 in the second rinsing tank 1,2 is fully closed in liquidtight fashion in the section of FIG. 1. To this end, both the upper and lower margins of the container wall 1*e* in the second rinsing tank 1,2 are welded to or otherwise made integral with the tank side wall 1*c* as shown at 1*p*. In contrast, only the lower margin of the container wall 1*e* in the first rinsing tank 1,2 is welded to or otherwise made integral with the respective tank side wall 1*c*. The margins of the container walls 1*e* may likewise be welded to or otherwise made integral with the inner surfaces of the corresponding tank end walls 2.

The containers 18 are coextensive with the respective rolls 3,4,5,8,9,10,10*a*,11, that is, the containers 18 span the lengths of the respective rolls 3,4,5,8,9,10,10*a*,11. The rolls 3,4,5,8,9,10,10*a*,11 in each of the rinsing tanks 1,2, together with the associated guide surfaces 13,14,15,16,17 and the guide surface on the container wall 1*e*, define a path for the photographic material 21 through the corresponding rinsing tank 1,2.

Unless stated to the contrary, the description from here on in will apply specifically to the second rinsing tank 1,2.

The container wall 1*e* is provided with a window 26 at the level of the light source 19. The window 26 is transparent to the radiation emitted by the light source 19 and extends across the entire width of the photographic material 21 or the entire width of the path travelled by the photographic material 21. The window 26 faces and is located near the path of the photographic material 21 and the light source 19 is arranged to illuminate such path. Since the photographic material 21 is conveyed closely by the window 26 with the emulsion 21*a* facing the window 26, the photographic material 21 undergoes an additional exposure during the second rinse in the second rinsing tank 1,2.

It can be seen that, by virtue of this construction, the film transporting means and film guide means for all treating tanks of the wet processing arrangement can have the same design. In other words, the film transporting means and the film guide means need no longer have a special design because of the light source 19 for the additional exposure. Moreover, since the tank 1,2 is opaque to the radiation emitted by the light source 19 and the latter is disposed not only in the tank 1,2 but also inside the container 18 within the tank 1,2, it is unnecessary to provide light shields between the two rinsing tanks 1,2. The drawings further show that the rack segment 7, as well as the rack segment 6 or the lower transporting rolls 3,4,5, can be removed for cleaning of the tank 1,2 in a simple fashion and without disassembling or removing the unit 18,19 for additional exposure of the photographic material 21.

The light source 19 is rod-shaped and extends generally parallel to the rolls **3,4,5,8, 9,10,10*a*,11. Preferably, the light source 19 spans the width of the photographic material 21 or the width of the path followed by the photographic material 21. In order to permit ready replacement of the light source 19, one of the end walls 2 of the tank 1,2 is provided with an opening 18*a* to the interior of the container 18. The opening 18*a*, which is covered in the drawings so that the location thereof can be determined only from the lead line for the reference numeral 18*a*, is accessible from the exterior of the tank 1,2. An elongated holder 22 in the form of a slide can be inserted in the container 18 through the opening 18*a* so as to extend generally parallel to the rolls 3,4,5,8,9,10,10*a*,11. The holder 22, which is designed to carry the light source 19, has a bent tab 22*a* at either side thereof. Sockets 23 for the light source 19 are secured to the respective tabs 22*a*. An end of the holder 22 projects through the opening 18*a* when the holder 22 is properly positioned in the container 18 and is in the form of a bent, plate-like or sheet-like flange 22*b* which then constitutes a closure for the opening 18*a*. The closure 22*b*, which may also be constructed as a pivotable flap, can be releasably connected to the adjacent end wall 2 of the tank 1,2. For instance, the closure 22*b* can be screwed to the adjoining end wall 2 of the tank 1,2. The holder 22 is thus removably mounted in the container 18**.

Electrical conductors 24 connect the sockets 23 to a potential source 25 mounted outside of, and preferably beneath, the tank 1,2. The conductors 24 can extend to the exterior of the tank 1,2 via the opening **18*a*. However, the closure 22*b* then cannot completely close the opening 18*a*. Accordingly, it is advantageous to provide the end wall 2 of the tank 1,2 opposite the opening 18*a* with a further opening 18*b* through which the conductors 24 can pass to the exterior of the tank 1,2**.

It will be understood that the unit 18,19 for additional exposure of the photographic material 21 need not necessarily be located in the second rinsing tank 1,2. Thus, the unit 18,19 may be mounted in another tank of the wet processing arrangement should the developing process make this necessary or desirable.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of the instant contribution to the art and, therefore, such adaptations should and are intended to be comprehended within the meaning and range of equivalence of the appended claims.

What is claimed is:

1. An arrangement for wet processing exposed photosensitive material, comprising at least one vessel for a treating bath; a source of electromagnetic radiation in said at least one vessel; a container in said at least one vessel, said container having a section transparent to the radiation and said source being disposed in said container, said container being bounded by wall means and said wall means being provided with at least one opening which is accessible from exteriorly of said at least one vessel; and a holder for said source, said holder being insertable into and removable from said container through said at least one opening.

2. The arrangement of claim 1, wherein said container is liquidtight.

3. The arrangement of claim 1, further comprising transporting means in said one vessel defining a predetermined path for the photosensitive material, said container being at least approximately coextensive with said transporting means.

4. The arrangement of claim 3, wherein said path has a predetermined width and said transparent section extends substantially across said predetermined width, said transparent section and said source being arranged to irradiate said path.

5. The arrangement of claim 3, wherein said transporting means comprises a plurality of rolls arranged to draw the photosensitive material into said at least one vessel, convey the photosensitive material through said at least one vessel and discharge the photosensitive material from said at least one vessel.

6. The arrangement of claim 1, comprising at least one additional vessel for at least one additional treating bath.

7. The arrangement of claim 1, wherein said at least one vessel accommodates a rinsing bath.

8. The arrangement of claim 7, further comprising means for transporting the photosensitive material through said at least one vessel in a predetermined direction, and an additional vessel with a rinsing bath upstream of and adjacent to said at least one vessel.

9. The arrangement of claim 1, wherein said container is welded to said wall means.

10. The arrangement of claim 1, wherein said wall means comprises a pair of oppositely disposed end walls and said container has a pair of oppositely disposed ends which are integral with the respective end walls.

11. The arrangement of claim 1, wherein said wall means includes a pair of oppositely disposed end walls and said one opening is located in one of said end walls.

12. The arrangement of claim 1, further comprising transporting means in said at least one vessel defining a predetermined path for the photosensitive material, said transporting means being elongated and extending along a predetermined direction, and said path having a predetermined width as considered along said predetermined direction, said transparent section extending substantially across said predetermined width, and said source and said transparent section being arranged to irradiate said path, said source and said holder being elongated and designed to extend in substantial parallelism with said transporting means, and said holder having longitudinally spaced end portions provided with respective receiving elements for said source.

13. The arrangement of claim 1, wherein said holder includes a closure for said opening arranged to be located externally of the latter when said holder is in said container.

14. The arrangement of claim 13, wherein said closure is releasably connectible with said wall means.

15. The arrangement of claim 13, wherein said closure comprises a flap.

16. The arrangement of claim 13, wherein said closure comprises a plate-like flange.

17. The arrangement of claim 1, wherein said wall means includes a pair of oppositely disposed walls and said one opening is provided in one of said walls, the other of said walls being provided with an additional opening to the exterior of said at least one vessel; and further comprising electrical conductors arranged to extend from said holder through said additional opening.

18. The arrangement of claim 1, wherein said source is a light source.

* * * * *